US006746377B2

(12) United States Patent
Johnston

(10) Patent No.: US 6,746,377 B2
(45) **Date of Patent: *Jun. 8, 2004**

(54) ADJUSTABLE PEDAL EXERCISE APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 0 days.

This patent is subject to a terminal disclaimer.

(21) Appl. No.: 10/219,265

(22) Filed: Aug. 15, 2002

(65) Prior Publication Data

US 2003/0109361 A1 Jun. 12, 2003

Related U.S. Application Data

(63) Continuation of application No. 09/605,283, filed on Jun. 28, 2000, now Pat. No. 6,436,010, which is a continuation of application No. 09/009,420, filed on Jan. 20, 1998, now Pat. No. 6,120,417, which is a continuation-in-part of application No. 08/868,516, filed on Jun. 4, 1997, now Pat. No. 5,944,636, and a continuation-in-part of application No. 08/385,646, filed on Feb. 8, 1995, now Pat. No. 5,647,821, and a continuation-in-part of application No. 08/136,102, filed on Oct. 13, 1993, now Pat. No. 5,387,167, and a continuation-in-part of application No. 07/970,168, filed on Nov. 2, 1992, now Pat. No. 5,403,255.

(51) Int. Cl.[7] ..... A63B 21/00
(52) U.S. Cl. ..... 482/57; 482/52
(58) Field of Search ..... 482/51, 52, 57, 482/70, 148; 601/23, 27, 34–36

(56) References Cited

U.S. PATENT DOCUMENTS

| | | | | | |
|---|---|---|---|---|---|
| 4,779,863 | A | * | 10/1988 | Yang | 482/51 |
| 4,786,050 | A | * | 11/1988 | Geschwender | 482/57 |
| 5,630,774 | A | * | 5/1997 | Geschwender | 482/57 |
| 6,120,417 | A | * | 9/2000 | Johnston | 482/57 |
| 6,251,050 | B1 | * | 6/2001 | Johnston | 482/57 |
| 6,436,010 | B1 | * | 8/2002 | Johnston | 482/57 |

* cited by examiner

*Primary Examiner*—Stephen R. Crow

(57) ABSTRACT

An adjustable pedal exercise apparatus is provided which a user operates while in a standing position. The apparatus includes a rotation assembly mounted on a frame structure. This rotation assembly includes a plurality of rotational members connected together by either a closed loop or intermediate rotatable members. Cranks are attached to and extend from each side of each rotational member. A pedal is located on each side which bridges the cranks on that side. The cranks are arranged such that the pedals are opposingly positioned and travel their path of rotation while remaining in a substantially horizontal position. The pedals and cranks may have adjusting features which enable the apparatus to be configured such that the foot pedals follow more of a circular path and also configured to follow more of an elliptical path. Optional handles and variable resistance provide adjustable support and multiple work levels for the user. Another option is a motor for producing automatic movement of the pedals.

8 Claims, 14 Drawing Sheets

ADJUSTABLE PEDAL EXERCISE APPARATUS

CROSS REFERENCE TO RELATED APPLICATIONS

This application is a Continuation of U.S. patent application Ser. No. 09/605,283, filed Jun. 28, 2000 now U.S. Pat. No. 6,436,010. Application Ser. No. 09/605,283 is a Continuation of U.S. patent application Ser. No. 09/009,420, filed Jan. 20, 1998, now U.S. Pat. No. 6,120,417, issued Sep. 19, 2000. U.S. Pat. No. 6,120,417 is a Continuation-In-Part of U.S. patent application Ser. No. 08/868,516, filed Jun. 4, 1997, now U.S. Pat. No. 5,944,636, a Continuation-In-Part of U.S. patent application Ser. No. 07/970,168, filed Nov. 2, 1992, now U.S. Pat. No. 5,403,255, a Continuation-In-Part of U.S. patent application Ser. No. 08/136,102, filed Oct. 13, 1993, now U.S. Pat. No. 5,387,167, and a Continuation-In-Part of U.S. patent application Ser. No. 08/385,646, filed Feb. 8, 1995, now U.S. Pat. No. 5,647,821.

BACKGROUND OF THE INVENTION

This invention relates to an adjustable pedal exercise apparatus which has an upright structure that allows the user to perform pedaling exercise routines while in a standing position. This feature allows for a more overall lower body workout than provided by more conventional lower body exercise devices such as cycles, treadmills, stair-steppers, and skiing or gliding machines.

As may be seen, there already exist many variations of lower body exercise devices. While these offer relatively good exercise, they all appear to be one dimensional. Most types of cycling products utilize a seat means, and those which do allow for pedaling in a standing position are not very easy to operate due to difficulties with the use keeping good balance. Current stair-stepper exercise devices and gliding or skiing devices allow for very little rotary motion in the hip and stomach area. The stair-steppers allow for only upward and downward motion in the user, while gliding or skiing devices allow only for backward and forward motion in the user. Treadmills do provide for rotary motion in the hips and stomach, but forces act against the user only as the user steps on the treadmill base. This new exercise device provides a force against the user during upward, downward, backward, and forward leg motion, and therefore also much more rotary motion in the hip and stomach area. Given the fact that there are a vast number of exercise devices, in particular pedaling type devices, it has come as a surprise that no one has effectively designed a cycling device which may be easily operated from a standing position. The standing position provides a greater overall lower body workout than other pedaling type products.

SUMMARY AND OBJECTS OF THE INVENTION

It is the object of this invention to provide a pedaling device which is comfortable and easy to operate while in a standing position. One version allows for manual operation of the device, with rotary motion in the foot engaging assembly of the device being induced by the user. A second version of the device allows for automatic operation of the device, whereby the rotary motion is induced by a motor. Both of these features allow a more complete lower body workout than afforded by more conventional lower body exercise products.

It is the further object of this invention to provide a rotating exercise device which is adjustable for different user heights and/or arm lengths, stance widths, and overall leg motion. It is also an object of this invention to provide a device which is collapseable into a more compact configuration, and may have the necessary wheel attachments for easy relocation and/or storage.

In addition, the invention may contain an upper body workout means operating in conjunction with the lower body exercise feature. This would greatly increase the capabilities of the device.

Briefly stated, the apparatus that forms the basis of the present invention comprises basically a frame structure means and a foot engagement means. In one version of the device, a resistance means operates in conjunction with the foot engagement means, whereby rotary motion in the foot engagement means in manually induced by the user. The resistance means may be adjustable to vary the resistance to motion of the foot engagement means. A second version contains a motor means instead of a resistance means, whereby rotary motion in the foot engagement means is automatically induced by the motor. Both of these versions may have an upper body workout feature which operates in conjunction with the foot engagement means.

The frame structure means comprises a frame base upon which the foot engagement means mounts. Also part of the base may be an upwardly extending handle member onto which the user holds while operating the foot engagement means. It assist the user in maintaining better balance. As stated, a foot engagement means is also part of the device. The design of the foot engagement means is such that the foot engaging members, upon which the user places their feet, always remain in a substantially horizontal position as the members move along their path of rotation. This feature is not found in other pedaling devices. The ability of the foot engaging members to maintain a substantially horizontal position is due to a rotational translating means, which will be described later.

As mentioned previously, a resistance means may also operate in conjunction with the foot engagement means so that a resistance to motion may be applied to the foot engaging members. This would be utilized during manual operation of the apparatus by the user, with the amount of resistance being adjustable. Instead of a resistance means, a motor means may be used for automatic device operation, with motion in the foot engaging members being induced by a motor, not the user.

The apparatus may be configurable for different operating capabilities, with the frame being adjusatble for different user heights and arm lengths. Also, the foot engaging means may be adjustable so that different paths of rotation in the foot engaging members may be utilized, and the user may also vary their width of stance.

The apparatus may also be collapseable into a more compact configuration by repositioning the handle member to reduce overall device heigth. Also included on the device frame may be a wheel assembly on at least one end, so that the opposite end may be lifted and the entire device relocated to a new area. If a wheel assembly is located at both ends, the device may be rolled to a new area without being lifted at one end.

An upper body workout means may also be part of the apparatus, which operates in conjunction with the foot engagement means. The upper body workout means may comprise two hand engaging members, which move in opposite forward and backward directions as the foot engaging members move along their path of rotation. Each hand engaging members may be rigidly mounted to a corresponding foot engaging members, or each may be operatively connected to the members in some manner.

Also, a typical exercise computer may also be part of the apparatus. It is not shown in the accompanying figures, but may connect in some manner to the foot engagement means and keep track of exercise related data such as speed, distance, time, calories, etc.

Other objects, features, and advantages for this invention will be apparent from the following detailed description and the appended claims, references being made to the accompanying drawings forming a part of the specification, wherein like reference numerals designate corresponding parts of several views.

BRIEF DESCRIPTION OF THE DRAWINGS

FIG. 3F is a front view of the second type of the foot engagement means.

FIG. 3G is a side view of the foot engagement means demonstrating a feature for adjusting the foot engaging member path of rotation.

FIG. 3H is a side view of the foot engagement means demonstrating a feature for allowing the user to vary their width of stance.

FIG. 3I is a side view of the foot engagement means demonstrating a second feature for allowing the user to vary their width of stance.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description, not limitation.

Figure 1A:
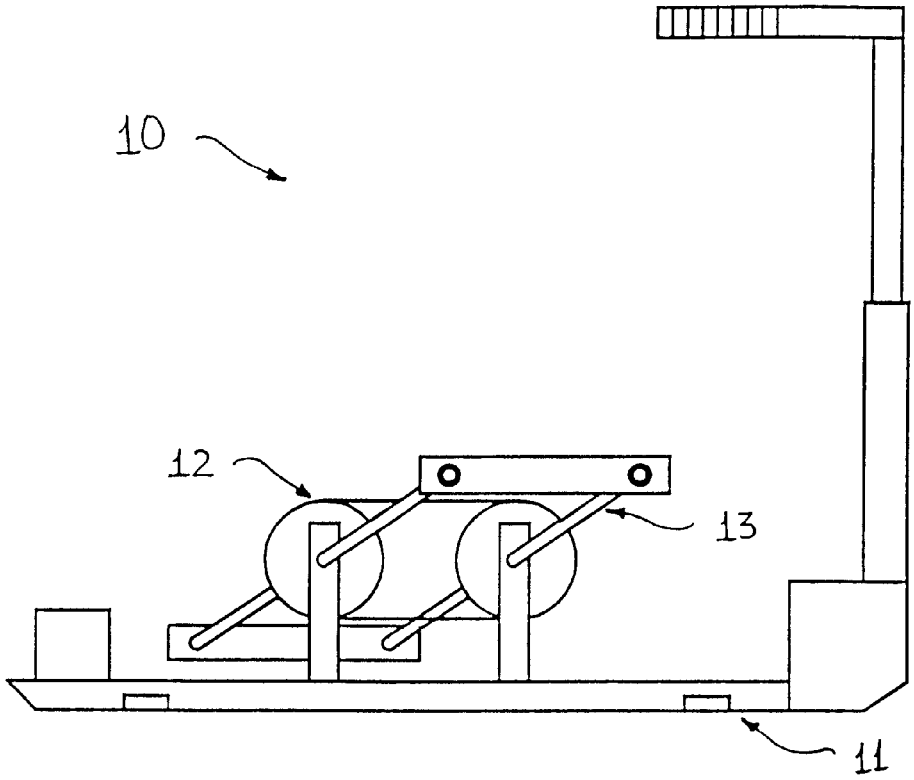
FIG. 1A is a side view of the pedaling exercise apparatus.
Figure 1B:
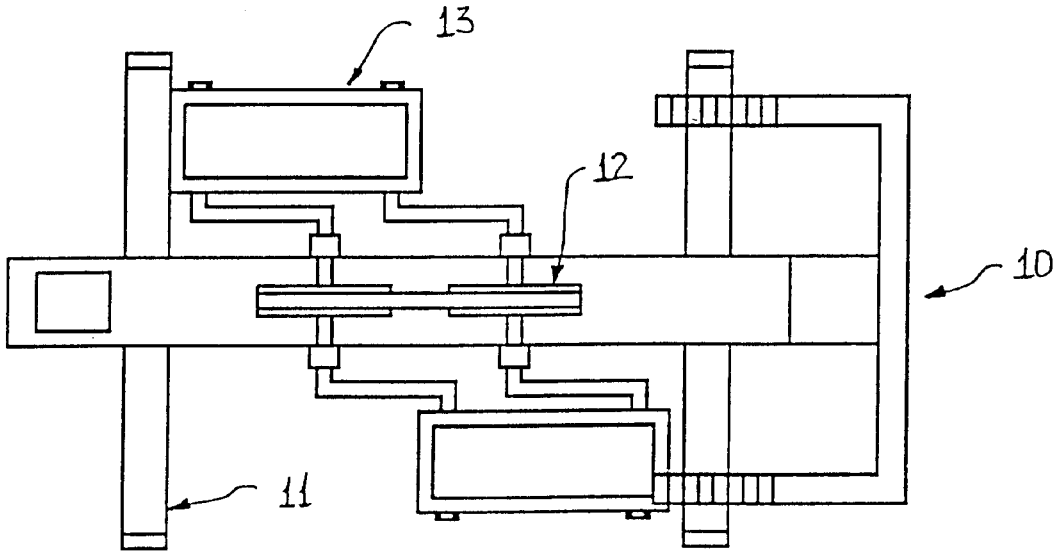
FIG. 1B is a top view of the pedaling exercise apparatus.
Figure 1C:
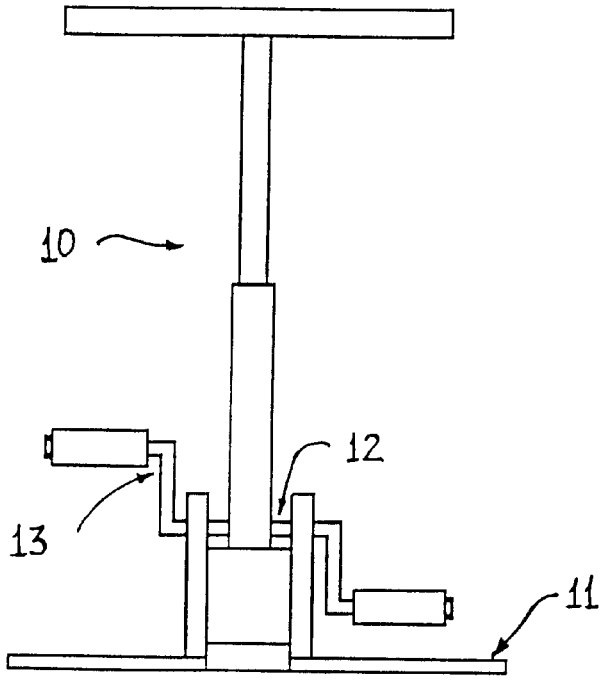
FIG. 1C is a front view of the pedaling exercise apparatus.

As best can be seen by references to the drawings, and in particular to FIGS. 1A though 1C, the pedaling exercise apparatus that forms the basis of the present invention is designated by the reference numberal 10. Pedaling exercise apparatus 10 basically comprises a frame structure means 11 and a foot engagement means 12.

Figure 1D:
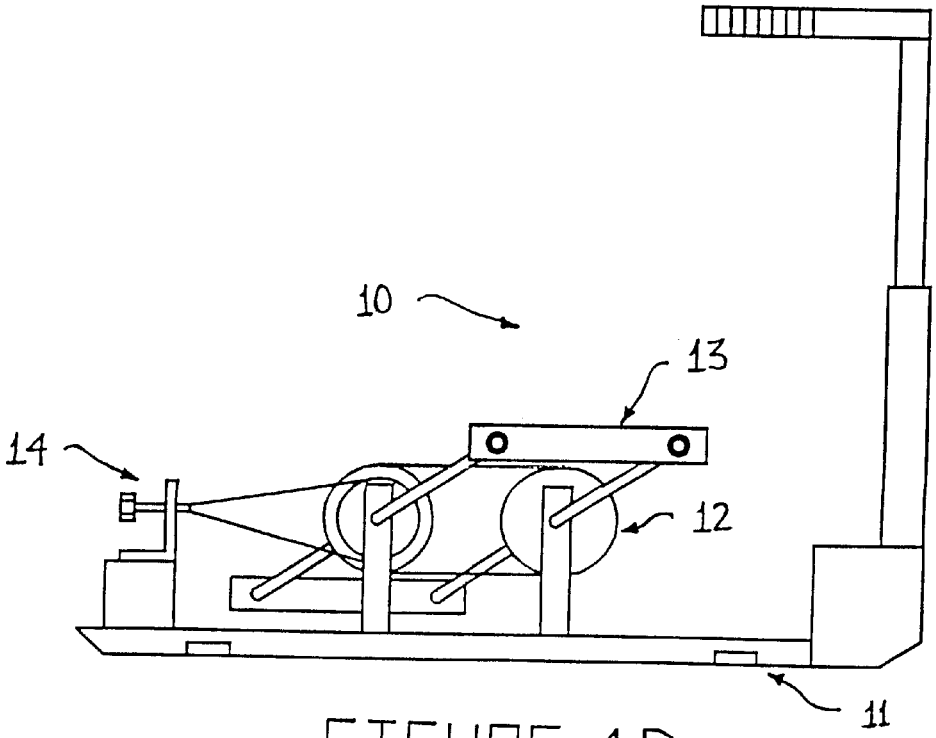
FIG. 1D is a side view of the apparatus utilizing a resistance means.
Figure 1E:
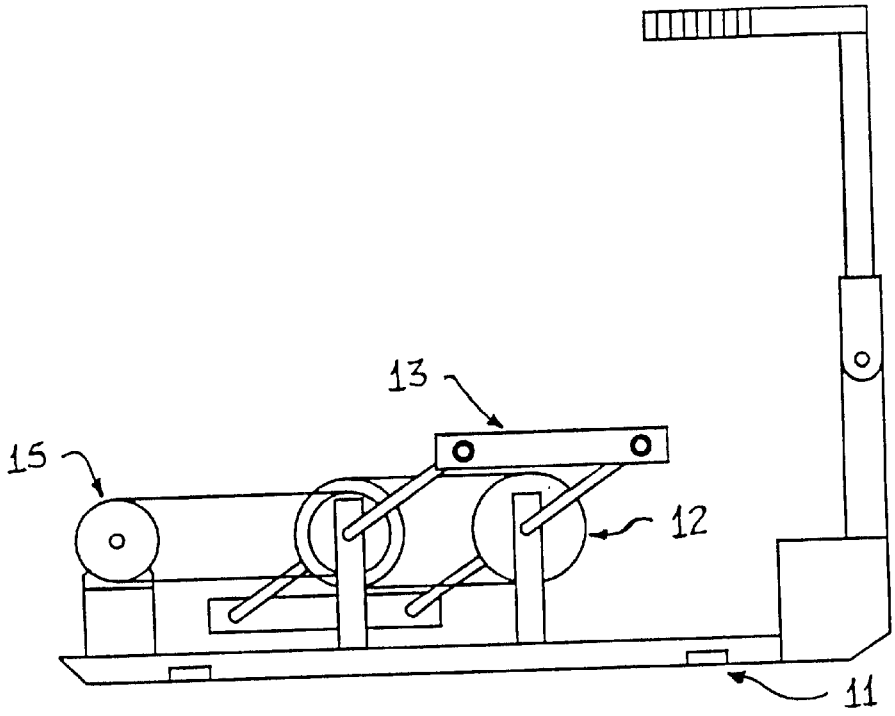
FIG. 1E is a side view of the apparatus utilizing a motor means.

As further shown in FIGS. 1D and 1E, a resistance means 14 and a motor means 15 may be utilized in the apparatus. The resistance means 14 may be used to provide a resistance to rotation in the foot engagement means 12 during manual operation. The motor means 15 may be used to induce rotation in the foot engagement means. This is for automatic device operation. Both of these features will be described in detail later on in the specification.

Figure 2A:
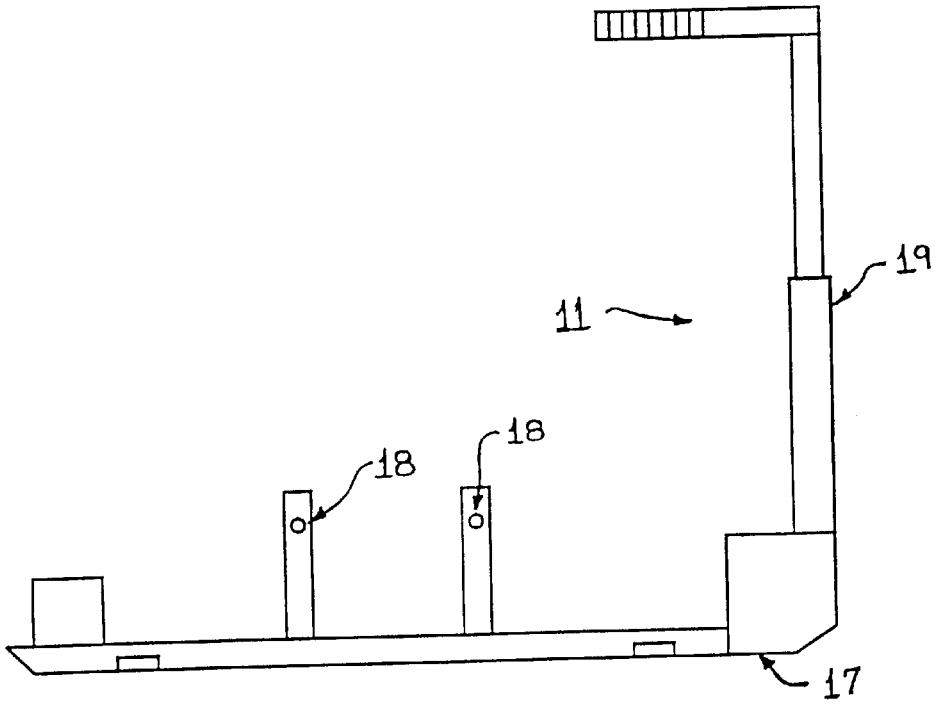
FIG. 2A is a side view of the frame structure means.
Figure 2B:
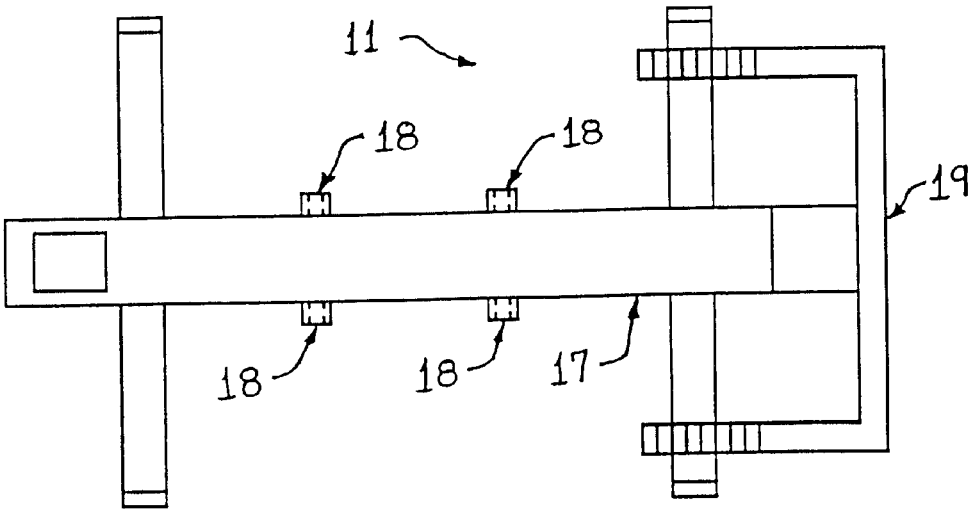
FIG. 2B is a top view of the frame structure means.
Figure 2C:
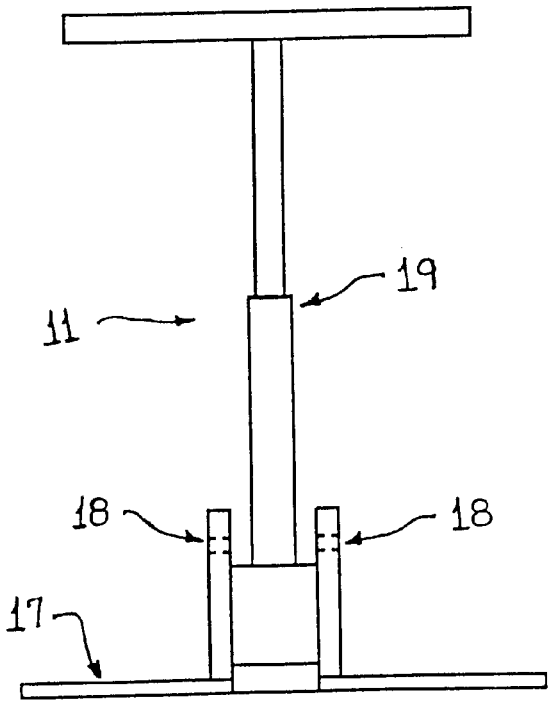
FIG. 2C is a front view of the frame structure means.
Figure 2D:
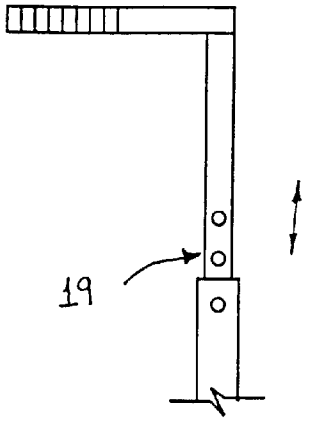
FIG. 2D is a side view of the frame structure means demonstrating an adjustable handle member for different user heigths.
Figure 2E:
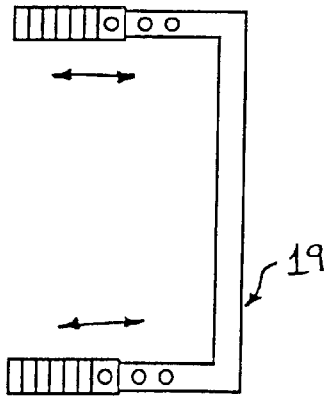
FIG. 2E is a side view of the frame structure means demonstrating an adjustable handle member for different arm lengths.

Referring to FIGS. 2A, 2B, and 2C, frame structure means 11 comprises a base structure 17 having structure openings 18 used to mount the foot engagement means 12. A handle member 19 may also be part of the frame structure means and assist the user in maintaining proper balance. As shown in FIGS. 2D and 2E, the handle member 19 may be adjustable for different user heigths and arm lengths. The base structure 17 is also used to support resistance means 14 and motor means 15.

Figure 3A:
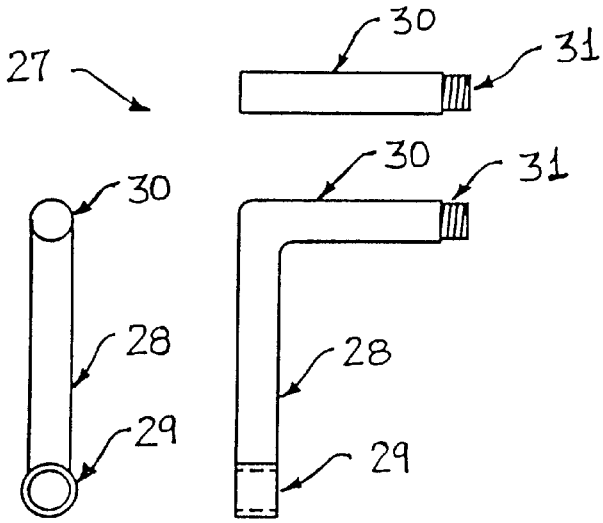
FIG. 3A is a side, top, and front view of the connection member of the foot engagement means.
Figure 3B:
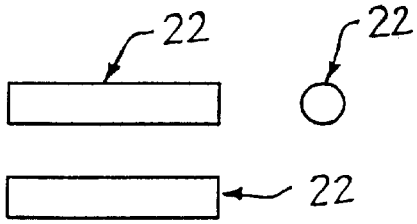
FIG. 3B is a side, top, and front view of the shaft member of the foot engagement means.
Figure 3C:
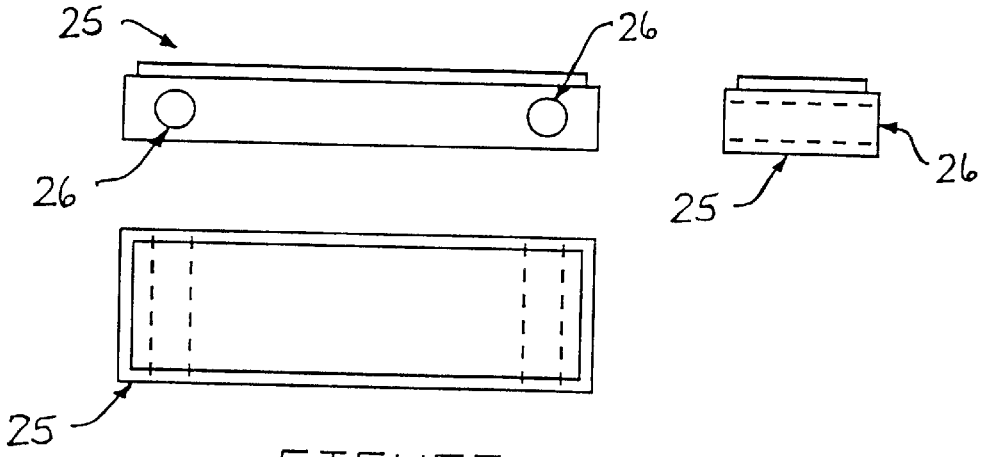
FIG. 3C is a side, top, and front view of the foot engaging member of the foot engagement means.

As may be seen in FIGS. 3A through 3C, foot engagement means 12 comprises foot engagement members 25, connection members 27, and shaft members 22. Connection member 27 is a generally L-shaped structure having a first leg 28 and a second leg 30. The angle between the two legs is preferred to be ninety degrees, but does not necessarily have to be. At the end of the first leg 28 is shaft opening 29, which receives shaft member 22, and is rigidly connected together using a bolt, weld, or the like. Therefore shaft member 22 and connection member 27 rotate simultaneously. Foot engaging member 25 is a relatively flat structure upon which the user places their foot. It contains a tubular-like opening 26 through the side, which lossely receives the second leg 30 of connection member 27. This is a means for pivotally coupling the foot engaging member 25 to the first leg 28. Second leg 30 has a threaded end so bolt nut member 32 may be attached to keep foot engaging member 25 in position. It is desireable for each foot engaging member 25 to be supported by at least two connection members 27.

Figure 3D:
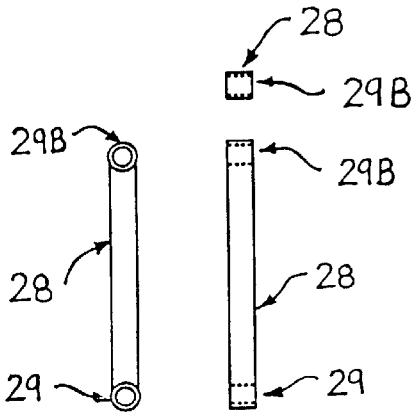
FIG. 3D is a side, top, and front view of a second type of connection member of the foot engagement means.
Figure 3E:
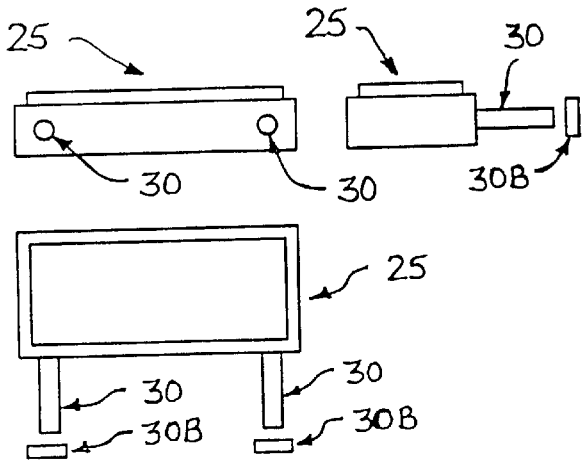
FIG. 3E is a side, top, and front view of a second type of foot engaging member of the foot engagement means.

FIGS. 3D through 3F demonstrates a second means for pivotally coupling the foot engaging member 25 to the first leg 28. First leg 28 now has a second shaft opening 29*b* located at the opposite end from shaft opening 29. Shaft opening 29*b* is sized to loosely receive one end of second leg 30. The other end of second leg 30 is rigidly mounted to foot engaging member 25. Second leg 30 thus is free to pivot within shaft opening 29*b*, thus allowing foot engaging member 25 to be pivotally coupled to first leg 28. Shaft opening 29*b* may contain some type of bearing to make the pivoting motion smoother. A collar 30*b* may be placed on one end of second leg 30 to connect it to first leg 28.

As seen in FIG. 3G, the first leg 28 may have an adjustability feature to increase or decrease the leg length. Shown is a typical telescoping feature in which the overall length of first leg 28 may be altered and secured through some type of securing means such as a pin or bolt. This feature allows for the adjustment of the path of rotation for the foot engaging members. FIGS. 3H and 3I demonstrate the ability of the user to position themselves at different widths of stance. FIG. 3H shows the second leg 30 of connection member 27 being long enough to support a foot engaging member 25, which is wide enough to support different foot positions. FIG. 3I shows a foot engaging member 25 used with a spacer 33 to position foot engaging member 25 at different positions along second leg 30. The spacer may be placed on the inside or outside of foot engaging member 25.

Figure 4A:
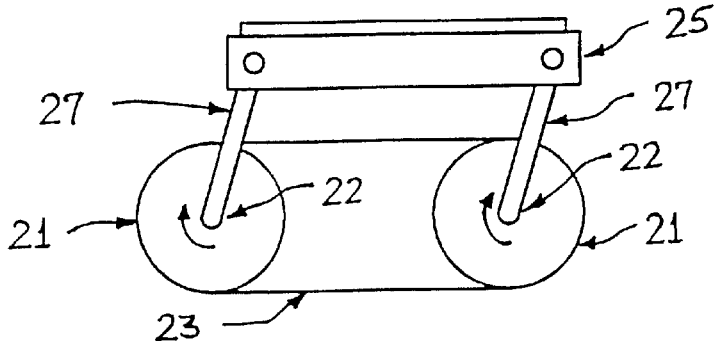
FIG. 4A is a side view of the foot engagement means showing one type of rotational translating means.
Figure 4B:
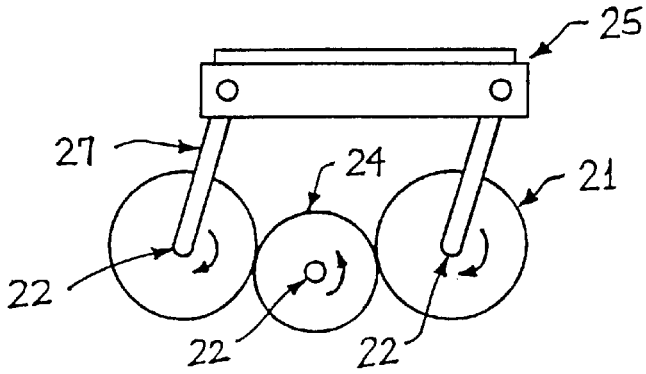
FIG. 4B is a side view of the foot engagement means showing a second type of rotational translating means.
Figure 4C:
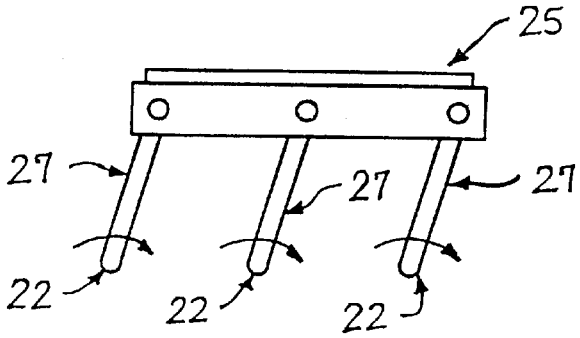
FIG. 4C is a side view of the foot engagement means showing a third type of rotational translating means.

Shown in FIGS. 4A, 4B, and 4C are three different types of rotational translating means, which are used to keep foot engaging memberes 25 at substantially horizontal positions as they move along their path of rotation. In order to achieve this, shaft members 22 of foot engagement means 12 must rotate in the same direction and at geneally the same angular velocity and acceleration.

FIG. 4A shows rotatable members 21 which are fixedly mounted on shaft members 22. Rotatable members 21 are operatively connected together by a closed loop connection means 23. The connection means 23 keeps rotatable members 21 rotating in the same direction and at generally the same angular velocity and acceleration, thereby allowing shaft members 22 to do the same. This is true provided rotatable members 21 are of generally the same diameter. This configuration is a typical drive train setup, such as sprockets and chains, pulleys and belts, gears and drive shafts, etc.

FIG. 4B demonstrates a second type of translating means. In this instance, there are again rotatable members 21 which are fixedly mounted on shaft members 22. At least one intermediate rotatable member 24 mounts similarly on base structure 17, and operatively connects rotatable members 24. It serves as the connection means. In the case shown, the intermediate rotatable member 24 is in rotating contact with both rotatable members 21. This intermediate rotatable member 24 keeps rotatable members 21 rotating in the same direction and at generally the same angular velocity and acceleration. Again, this is true if the rotatable members 21 are of generally the same diameter. It would be possible to have multiple intermediate rotatable members 24, all operatively conected together and rotating simultaneously. These intermediate rotatable members would also operatively connect rotatable members 21, thus serving as the connection means. In this case, the rotatable members 21 would not necessarily have to be of generally the same diameter. The configuration in FIG. 4B is a typical gear type assembly means, such as rotating gears with interfacing teeth, or roller members with enough friction between surfaces so that no slippage occurrs.

FIG. 4C demonstrates a third type of rotational translating means. In this version, an additional shaft member 22 is utilized, and an additional connection member 27 is added to each foot engaging member 25. These additional components enable foot engaging members 25 to maintain a substantially horizontal position, and keep shaft members 22 rotating in the same direction and at generally the same angular velocity and acceleration. Many variations of the rotational translating means shown in FIGS. 4A–4C exist, and the configurations listed are intended for demonstration purposes only.

Figure 5:
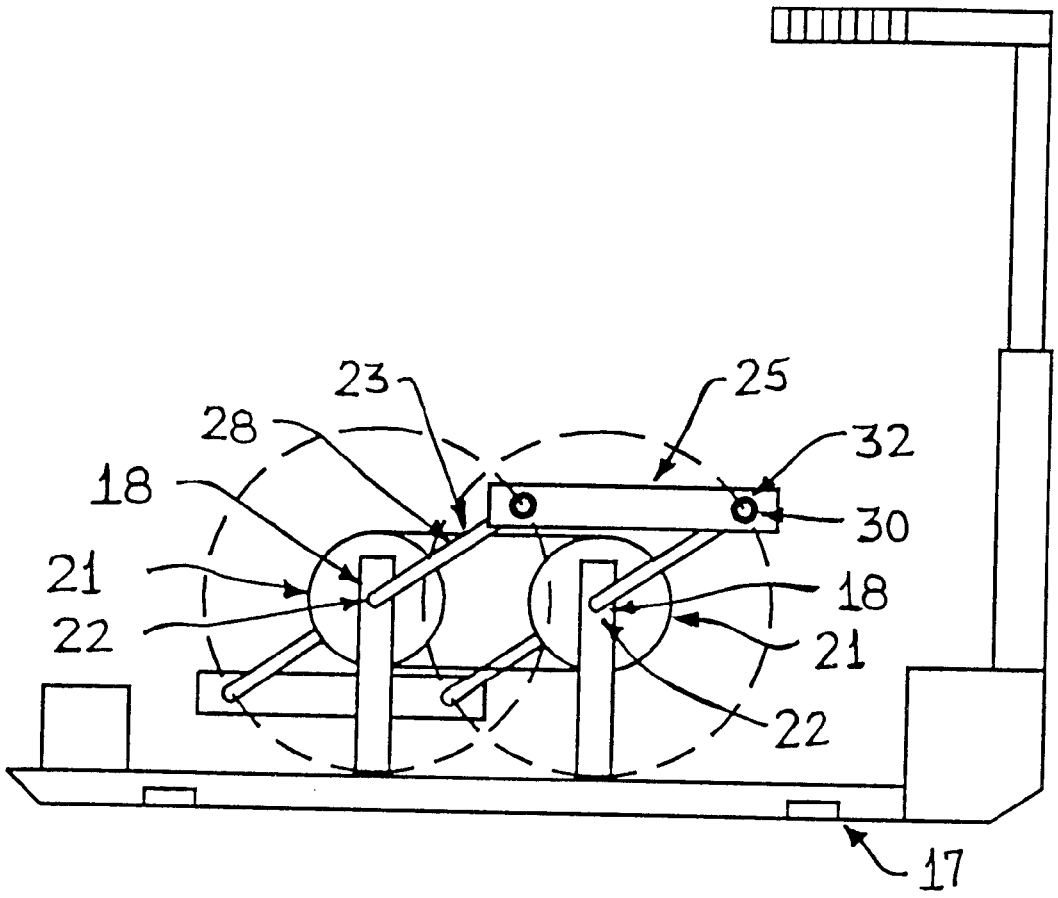
FIG. 5 is a side view of the foot engaging means as it mounts on the frame structure means, demonstrating the path of rotation as followed by the foot engaging members during device operation.

FIG. 5, along with the previous figures, demonstrates how frame structure means 11 and foot engagement means 12 operate in conjunction with one another. As seen, at least two shaft members 22 are rotatably coupled to base structure 17 through structure openings 18. Fixedly attached to the end of each shaft member 22 are connection members 27, at least two per side. The connection members on one side of the device are mounted at generally the same angle, while those on the opposite side are mounted at generally opposite angles to the previous ones. Each foot engaging member 25 loosely receives the second leg 30 of at least two connection members 27. In alternative form, each foot engaging member 25 may be rigidly connected to second leg 30, with second leg 30 being pivotally conected to first leg 28 of conection member 27.

In either case, since the connection members 27 are generally identical in length, and shaft members 22 are mounted on base structure 17 at generally the same level, the foot engaging members 25 will be in a substantially horizontal position, and remain so as long as the shaft members 22 rotate in the same direction and at generally the same angualr velocity and acceleration. This is ensured by rotational translating means 13. FIG. 5 demonstrates a rotational translating means comprised of two rotatable members 21 and a closed loop connection means 23.

As seen, foot engaging members 25 will rotate in a curved path when force is applied to the members by the feet of the user during manual operation of the apparatus, or motion is induced in shaft members 22 by a motor means during automatic operation. Movement of the foot engaging members 25 will be along the same path, but in generally opposite directions due to the opposite mounting of connection members 27, with respect to each side. The foot engaging members 25 may have the ability to move in the forward and reverse directions, which would make the device very flexible.

Figure 6A:
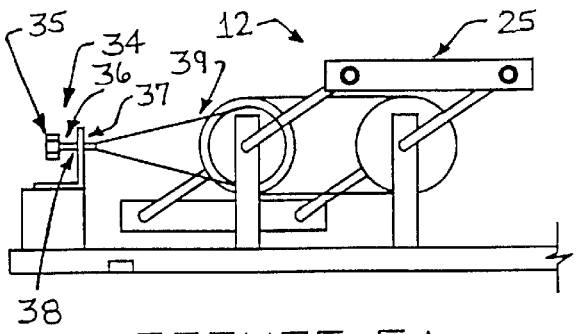
FIG. 6A is a side view of a resistance means operating in conjunction with the foot engagement means.
Figure 6B:
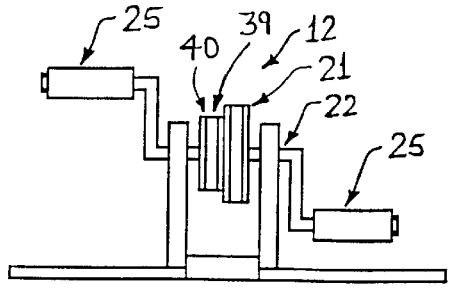
FIG. 6B is a top view of a resistance means operating in conjunction with the foot engagement means.
Figure 6C:
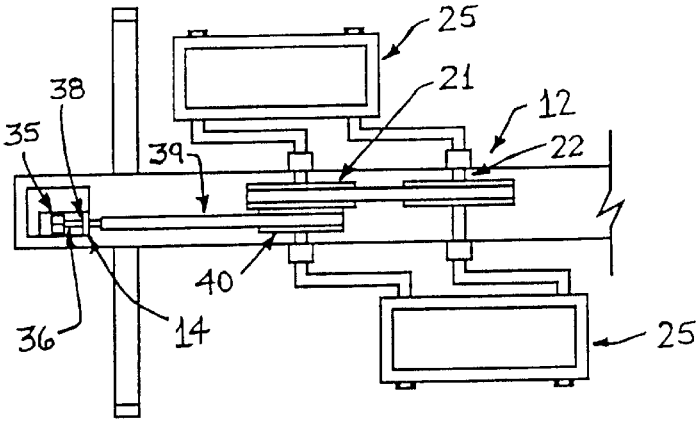
FIG. 6C is a front view of a resistance means operating in conjunction with the foot engagement means.

As may be seen in FIGS. 6A, 6B, and 6C, a resistance means 14 may be utilized by foot engagement means 12 to provide a resistance to motion in foot engaging members 25. Many different types of resistance means curently exist which may be utilized by this apparatus, and those shown in the application are for demonstration purposes only. The resistance means shown is a commonly known device which consists of an endless friction belt 39 which extends around at least a portion of the periphery of circular member 40. Circular member 40 is fixedly mouted to one of the shaft members 22, so that when shaft member 22 rotates, so will circular member 40. The tension on friction belt 39 is adjusted by tension adjustment means 34, which consist of a threaded shaft 36 and hand operated knob 35. The threaded shaft 36 of tension adjustment means 34 mounts through a threaded opening 38 of tension mount 37. The friction belt 39 loosely connects to threaded shaft 36 so that turning hand operated knob 35 does not cause friction belt 39 to twist, and the belt will not rotate as circular member 40 rotates. When the hand operated knob 35 is turned in one direction, threaded shaft 36 will turn accordingly and move backward, causing friction belt 39 to tighten against circular member 40. Upon turning the knob in the opposite direction, the belt will loosen. The force exerted by the friction belt 22 against circular member 40 produces a resistance to motion in circular member 40, shaft member 22, and therefore foot engaging member 25. The amount of force may be varied by the tension adjustment means 34.

Figure 6D:
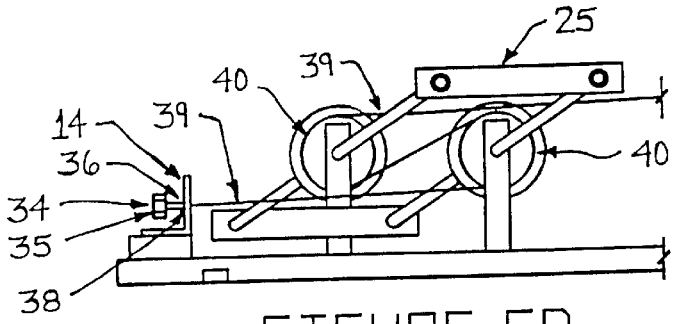
FIG. 6D is a side view of a second version of a resistance means operating in conjunction with the foot engagement means.

In may prove desireable to have a circular member 40 mounted on each shaft member 22, as shown in FIG. 6D. The friction belt 39 would then extend around a portion of the periphery of both circular members 40. This would allow much more resistance to be felt in the foot engaging members when the same amount of force is applied by the firction belt, as compared to having a single circular member 40. In this case, one end of friction belt 39 may be loosely connected to threaded shaft 36, while the other end may be rigidly connected to the frame structure.

Figure 7A:
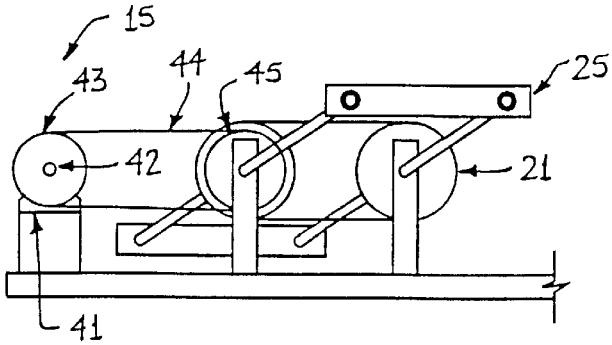
FIG. 7A is a side view of a motor means operating in conjunction with the foot engagement means.
Figure 7B:
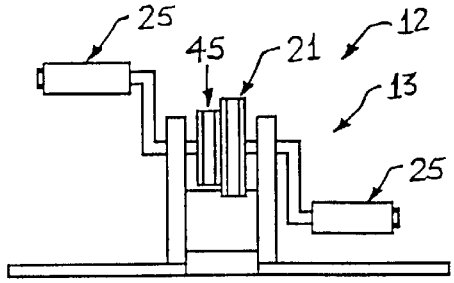
FIG. 7B is a top view of a motor means operating in conjunction with the foot engagement means.
Figure 7C:
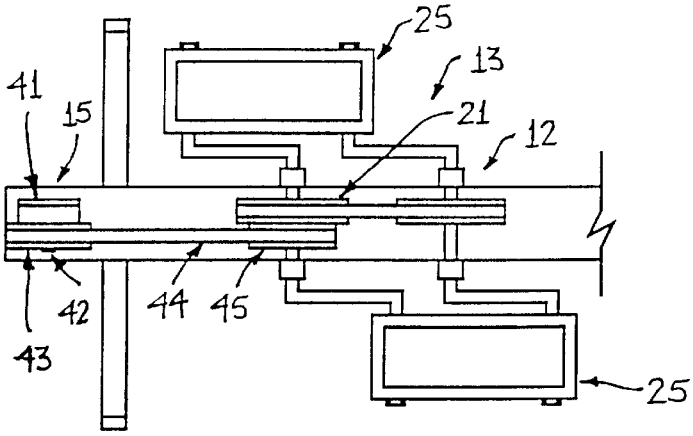
FIG. 7C is a front view of a motor means operating in conjunction with the foot engagement means.

FIGS. 7A through 7C demonstrate a typical motor means 15 which may be utilized by foot engagement means 12 for automatic operation of the apparatus. Rotation in foot engaging member 25 of foot engagement means 12 is produced by a motor, not the feet of the user. The motor means 15 comprises a motor 41 with a shaft rotatable member 43 fixedly mounted on motor shaft member 42. A motor rotatable member 45 is fixedly mounted on shaft member 22 of foot engagement means 12, with a closed loop connection member 44 operatively connecting shaft rotatable member 43 and motor rotatable member 45. As the motor shaft member 42 turns, so will shaft rotatable member 43 and motor rotatable member 45. Since motor rotatable member 45 is fixedly mounted on shaft member 22, shaft member 22 will rotate accordingly, thereby causing foot engaging members 25 to move along their path of rotation. Again, many variations of this asesembly may exist, the simplest of which would be a chain and sprocket assembly. The above assembly is intended for demonstration purposes.

Figure 8A:
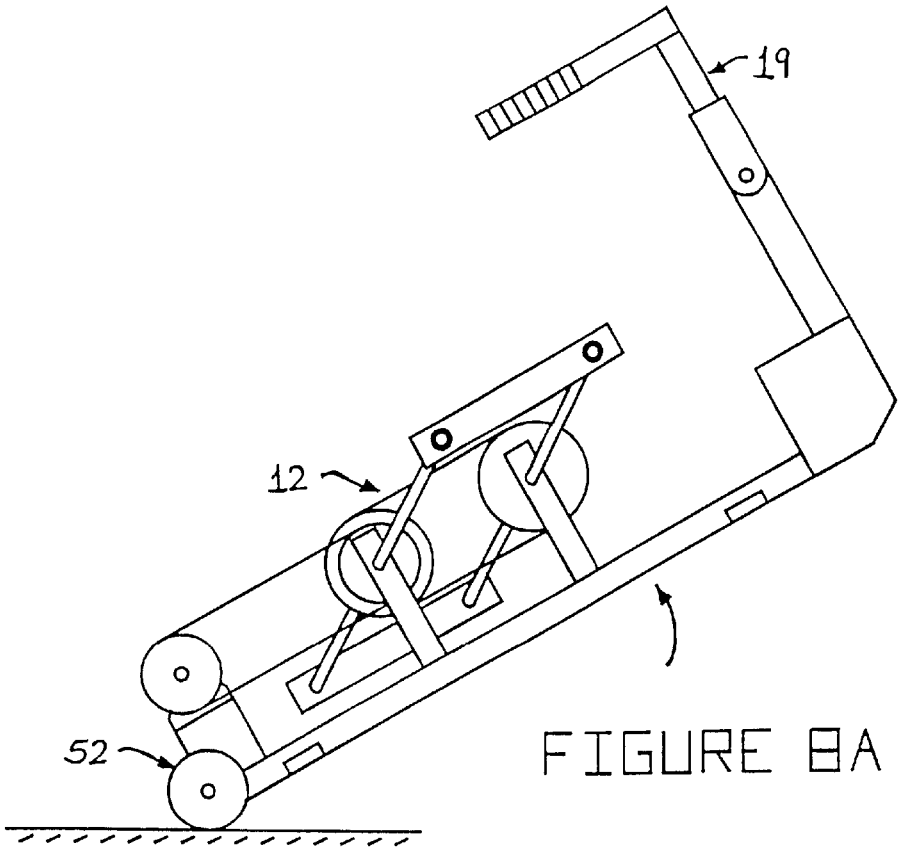
FIG. 8A is a side view of the apparatus demonstrating a collapseable handle member and wheel attachments for easy transport and storage.
Figure 8B:
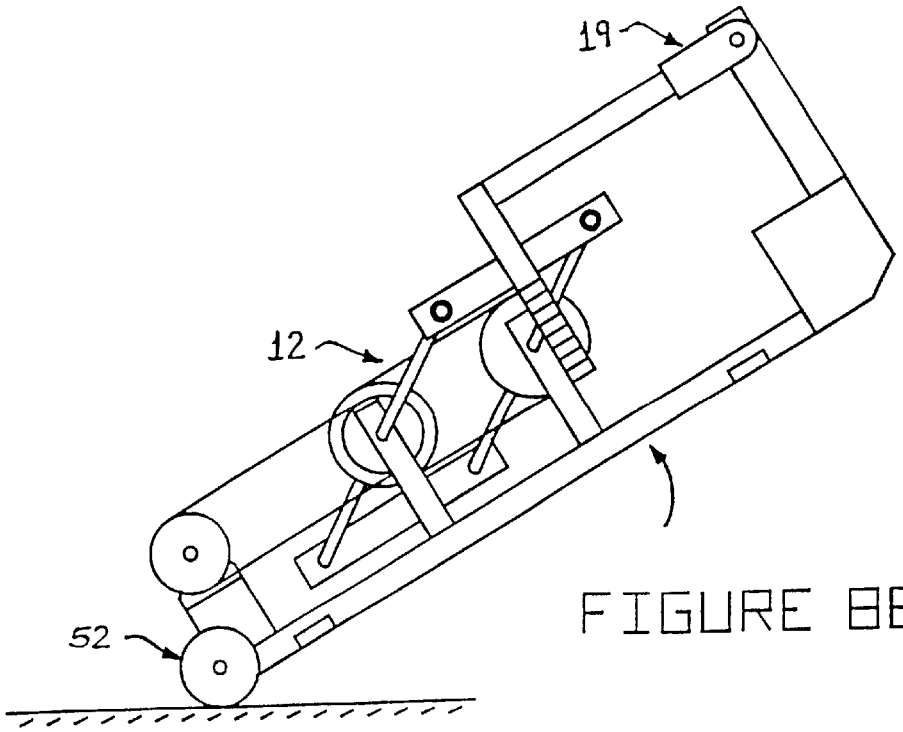
FIG. 8B is a side view of the apparatus demonstrating a second type of collapseable handle member and wheel attachments for easy transport and storage.
Figure 9A:
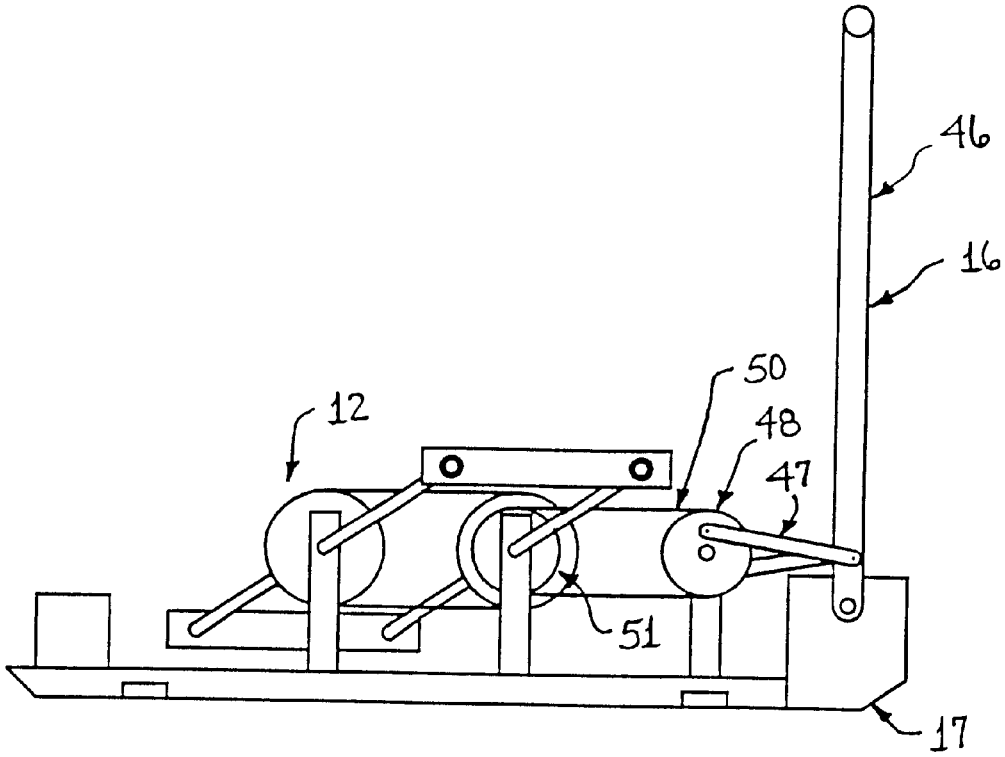
FIGS. 9A, 9B, and 9C are side, top, and front views, respectfully, of the apparatus with an upper body workout means operating in conjunction with the foot engagement means.
Figure 9B:
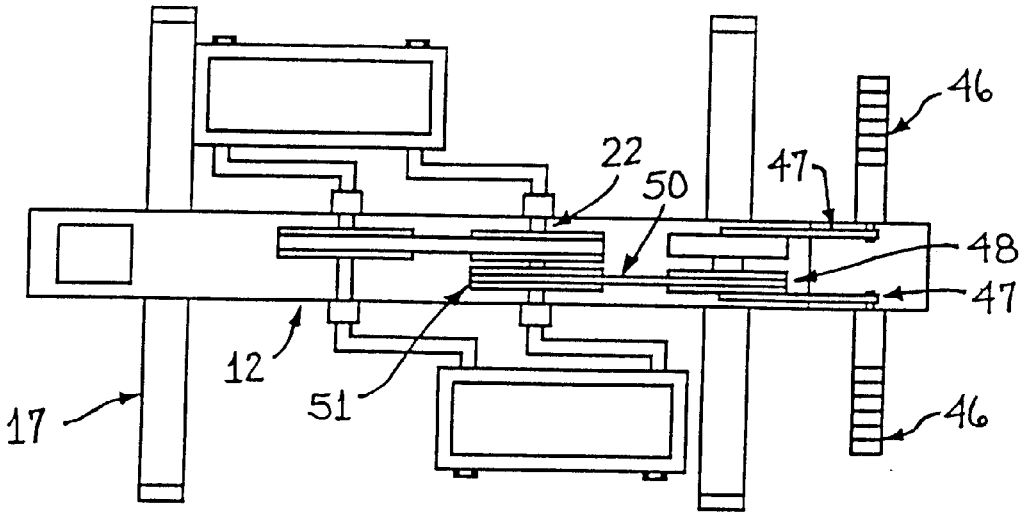
Figure 9C:
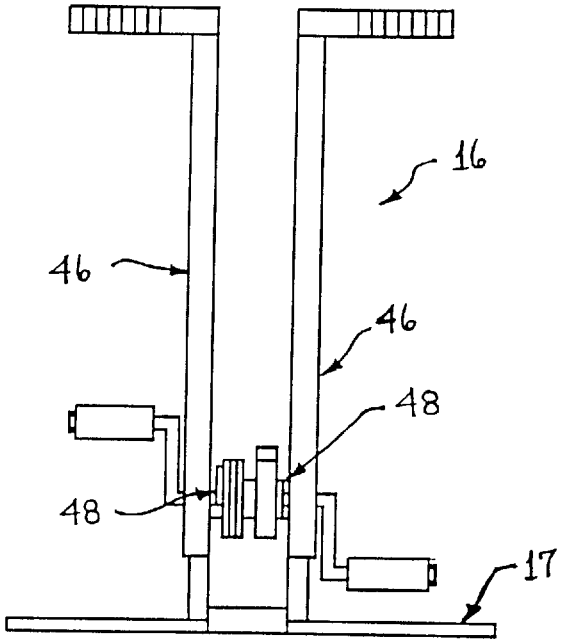
Figure 9D:
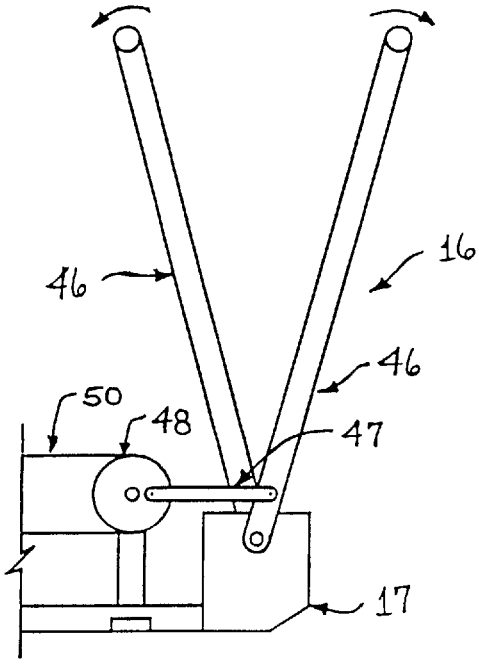
FIGS. 9D and 9E are side views of the upper body workout means demonstrating the back and forth rocking motion of the hand engagement means.
Figure 9E:
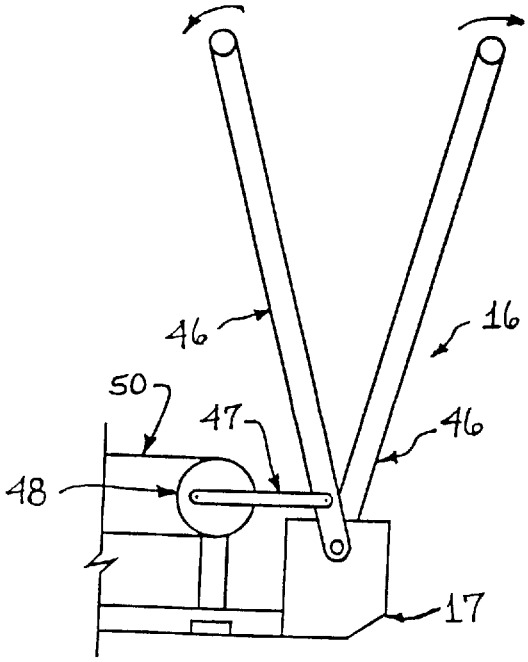

As may be seen in FIGS. 8A and 8B, frame structure means 11 may be collapsed into a more compact configuration for easier storage and relocation. In FIG. 8A, handle member 19 may be substantially lowered through a telescoping feature to reduce the overall heigth of the apparatus. FIG. 8B shows a handle member 19 which may be folded over, which also reduces the overall heigth of the apparatus. A handle member may be designed which incorporates both lowering abilities.

Also shown is a typical wheel assembly 52 mounted on base structure 17. This assembly is a basic wheel and axle assembly, mounted on at least one end of the apparatus so that the opposite end may be uplifted and the device rolled to a new location.

FIGS. 9A through 9E demonstrate an upper body workout means 16 which may operate in conjunction with foot engagement means 12. Upper body workout means 16 is an assembly which is commonly used in many treadmills, stair-steppers, and cycling devices. It consists of two hand engageable members 46 which are rotatably coupled to base structure 17. Both hand engageable members 46 are connected to motion transfer rotatable members 48, one to each, by coupling members 47. The connection is such that rotation in motion trnasfer rotatable member 48 will cause a backward and forward motion in the hand engageable members 46, the motion in each being opposite the other.

Motion transfer rotatable members 48 are rotatably mounted to base structure 17, and will rotate in the same direction and at generally the same angular velocity and acceleration. An assembly rotatable member 51 is fixedly mounted on shaft member 22 of foot engagement means 12. A closed loop connection means 50 operatively connects assembly rotatable member 51 and at least one motion transfer rotatable member 48, so that rotation in one produces rotation in the other. Therefore, the foot engaging members 25 of foot engagement means 12 will move along their path of rotation due to either manual foot operation or automatic motor operation, as discussed earlier, or through the user pushing and pulling back on the hand engageable members 46 with their hands.

The hand engageable members 46 may also be adjustable for different user heigths and for different grasping widths. The members may also have a typical telescoping feature so that they may be adjusted upward or downward. Also, the grasping part of the hand engageable members 46 may have a telescoping feature which lets the user adjust the width of grasp. The hand engageable members 46 may be collapseable into a more compact form by disconnecting the members from the motion transfer rotatable members 48 and folding the hand engageable members 46, or a collapseable feature similar to that for the handle member 19 shown in FIGS. 8A and 8B may be used. Also included may be a similar wheel assembly for easier relocation.

The Apparatus comprises bascially a structure frame means and a foot engagement means. The additional means include a resistance means, motor means, and an upper body workout means, which may be added singularly or in some combination with one another.

Figure 10A:
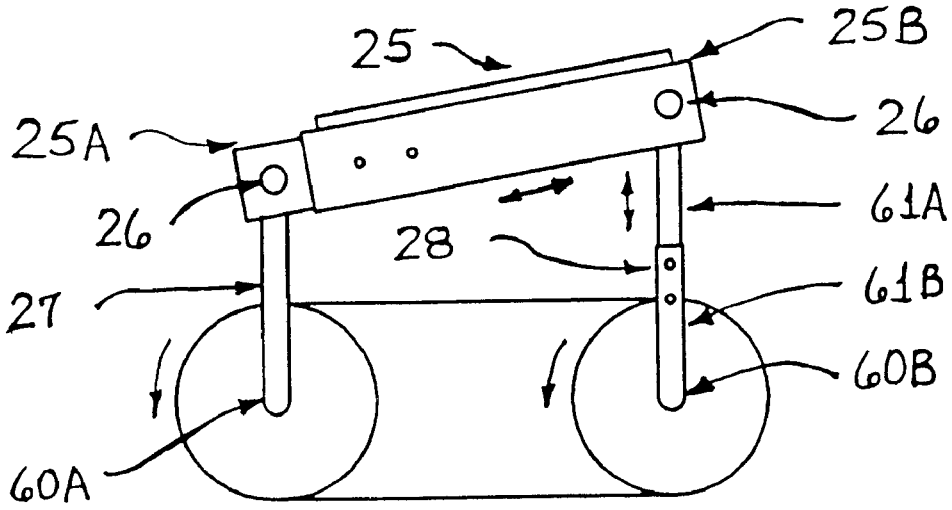
FIGS. 10A and 10B are side views of apparatus, demonstrating an adjustable foot engagement means and an adjustable connection means, which make the apparatus much more flexible.
Figure 10B:
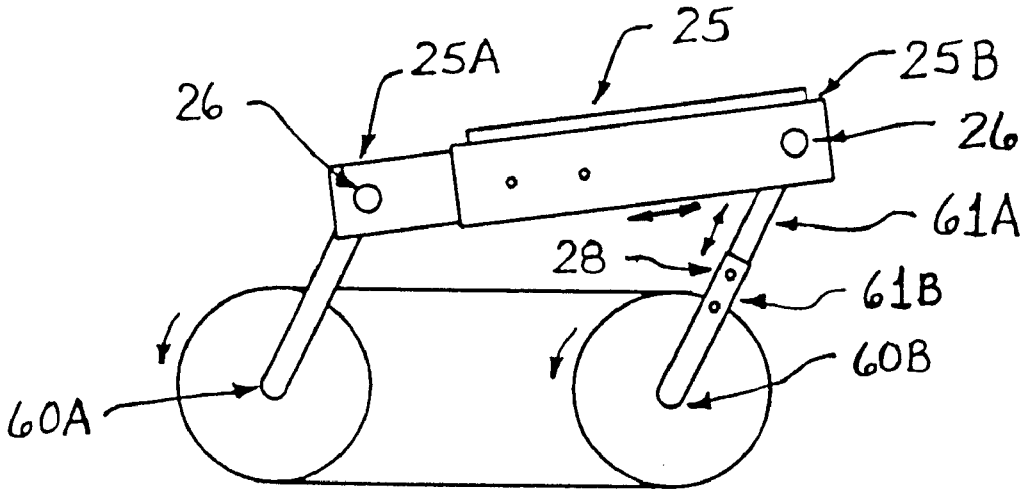

FIGS. 10A and 10B demonstrate the Apparatus with an adjustable foot engaging members 25 of the foot engagement meanas 12, and an adjustable first leg 28 of connection member 27. As may be seen, foot engaging member 25 may be composed of two separate components 25A and 25B. Component 25B has a hollow portion, while component 25A is sized to fit and move within component 25B, in a telescoping-like fashion. If the first leg 28 of one connection member 27 has a length different than the first leg 28 of the other connection member 27, then foot engaging member components 25A and 25B will move relative to one another as shaft members 22 rotate. The foot engaging members 25 would now follow a more elliptical path of motion, as opposed to the original circular path.

Each component 25A and 25B have sleeve openings for attaching to the second leg 30 of conenction member 27, and the flat portion of the foot engaging member 25 upon which the user would place their foot is located on component 25B. As was shown in FIG. 3G and previously described, the first leg 28 may be adjustable to different lengths, thereby allowing the user to configure the device for different elliptical paths.

The elliptical movement of the foot engaging members 25 may be produced using an alternate configuration. If components 25A and 25B are secured together through some securing means, such as a pin or bolt, and the adjustable first leg 28 is unsecured, then the foot engaging members will again follow an elliptical motion. The length of the foot engaging member must be greater than or less than the distance between the connection points 60A and 60B. The first leg components 61A and 61B will move relative to open another in a telescoping type fashion.

The device may also be configured to follow the original circular path of motion. If the adjustable first leg 28 is secured at a length equal to the other first leg 28, and the foot engaging components 25A and 25B are unsecured, then the foot engaging members will follow a circular path. Alternately, if the foot engaging member is secured at a length equal to the distance between the connection points, and the first leg 28 is unsecured, then again the circular path will be followed. Also, the first leg may be secured at a length equal to the other first leg 28, and the foot engaging components 25A and 25B may be secured at a length equal to the distance between the connection points 61A and 61B to produce the circular path of motion.

While it will be apparent that the preferred embodiment of the invention herein is well-calculated to fulfill the objects above stated, it will be appreciated that the invention is susceptible to modification, variation, and change without departing from the proper scope or fair meaning of the subjoined claims.

I claim:

1. An adjustable pedal exercise apparatus comprising;

a frame structure;

a rotation assembly mounted on said frame structure, wherein said rotation assembly includes at least two rotatable members rotatably mounted to said frame structure, said rotatable members being operatively connected by a connection means such that said rotatable members rotate at generally the same angular velocity and acceleration; and foot engagement means connected to said rotation assembly, wherein said foot engagement means includes connection members and two foot engaging members, each of said foot engaging members being connected to one side of each of said rotatable members through said connection members such that said foot engaging members remain in a generally horizontal posaition as said rotatable members rotate, said foot engaging members and said connection members being attached together along horizontal axes restricting relative movement to rotation about said axes;

each of said foot engaging members comprising a first and second component, said first and second components coupled together such that said first component moves along said second component, in the generally forward and backward directions, with one of said connection members pivotally coupled to the forward end of said first component, and one of said connection members pivotally coupled to the backward end of said second component; such that the distance between the forward end of said first component and the backward end of said second component may vary as said foot engaging members rotate, whereby a user may perform a cycling routine while in a standing position.

2. An adjustable pedal exercise apparatus according to claim 1, wherein said frame structure includes handle members moving in conjunction with said foot engaging members.

3. An adjustable pedal exercise apparatus according to claim 1, wherein said connection means and said rotatable members together comprise a sprockets and chain assembly.

4. An adjustable pedal exercise apparatus according to claim 1, wherein said connection meeans and said rotatable members together comprise a gear assembly.

5. An adjustable pedal exercise apparatus as claimed in claim 1, wherein each of said foot engaging members further comprises a relatively flat top surface, said attachment means of said foot engaging members comprising openings spaced along the side of sqaid foot engaging members to receive said connection members, each of said connection members is a substantially L-shaped structure having a first and second leg, said first leg includes means for rigid attachment to one of said shaft members, and said second leg including means for attachment with one degree of freedom to one of said foot engaging members.

6. An adjustable pedal exercise apparatus as claimed in claim 1, said apparatus further comprising a reistance means operatively connected to said foot engaging members of said foot engagement means, said resistance means providing resistance to the movement of said foot engaging members.

7. An adjustable pedal exercise apparatus as claimed in claim 1, further comprising a motor means used to induce motion in said foot engaging means.

8. A foot engagment means as claimed in claim 5, at least one of said connection members being adjustable, whereby the path of rotation of said foot engaging members may be selectively varied.

* * * * *